US008754815B2

(12) United States Patent
Leem

(10) Patent No.: US 8,754,815 B2
(45) Date of Patent: Jun. 17, 2014

(54) PORTABLE TERMINAL AND ANTENNA DEVICE THEREOF

(75) Inventor: Ji-Hun Leem, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 993 days.

(21) Appl. No.: 12/709,427

(22) Filed: Feb. 19, 2010

(65) Prior Publication Data

US 2010/0302110 A1 Dec. 2, 2010

(30) Foreign Application Priority Data

May 26, 2009 (KR) ..... 10-2009-0046102
Jul. 30, 2009 (KR) ..... 10-2009-0070255

(51) Int. Cl.
*H01Q 1/24* (2006.01)

(52) U.S. Cl.
USPC ..... 343/702; 343/846; 343/848

(58) Field of Classification Search
USPC ..... 343/702, 846, 848
See application file for complete search history.

(56) References Cited

U.S. PATENT DOCUMENTS

| | | | | |
|---|---|---|---|---|
| 2003/0146876 | A1 | 8/2003 | Greer et al. | |
| 2007/0001911 | A1 | 1/2007 | Fujio et al. | |
| 2007/0024508 | A1* | 2/2007 | Lee | 343/702 |
| 2007/0171136 | A1* | 7/2007 | Mitsui | 343/702 |
| 2008/0012778 | A1* | 1/2008 | Mitsui | 343/812 |
| 2008/0018538 | A1* | 1/2008 | Kushihi | 343/7 MS |

FOREIGN PATENT DOCUMENTS

| | | |
|---|---|---|
| EP | 1329980 | 7/2003 |
| WO | 2005/086277 | 9/2005 |

* cited by examiner

*Primary Examiner* — Dameon Levi
*Assistant Examiner* — Collin Dawkins
(74) *Attorney, Agent, or Firm* — Lee, Hong, Degerman, Kang & Waimey

(57) ABSTRACT

A portable terminal includes a terminal body, a first antenna provided on a circuit board having a first ground that is used by the first antenna, and an antenna assembly integrated into the terminal body. The antenna assembly of the portable terminal includes at least one diversity antenna fed to the circuit board and formed on the circuit board having a ground that is independent from the first ground. The at least one diversity antenna is formed into an angled configuration with respect to the circuit board.

9 Claims, 20 Drawing Sheets

PORTABLE TERMINAL AND ANTENNA DEVICE THEREOF

CROSS REFERENCE TO RELATED APPLICATIONS

Pursuant to 35 U.S.C. §119(a), this application claims the benefit of earlier filing date and right of priority to Korean Application Nos. 10-2009-0046102 filed on May 26, 2009 and 10-2009-0070255 filed on Jul. 30, 2009, the contents of which are hereby incorporated by reference herein in their entirety.

FIELD OF THE INVENTION

The present disclosure relates to a mobile terminal. In particular, the present disclosure relates to an antenna device of a portable terminal.

DESCRIPTION OF THE RELATED ART

Portable terminals can be easily carried and have one or more of functions, such as voice and video telephony, inputting and outputting information, and storing data. As the portable terminals become multifunctional, the portable terminals can also be used to capture still images or moving images, play music, video files or games, and receive broadcast, thus being implemented as integrated multimedia players.

Various new attempts have been made for the multimedia devices by hardware or software in order to implement such complicated functions. For example, a user interface environment is provided in order for users to easily and conveniently retrieve or select functions.

As the kinds and amounts of data transmitted through a portable terminal are increased, an attempt to enhance the performance of a wireless antenna, for example, multiple input multiple output (MIMO), to comply with the increased amount of data has been made. However, the trend of miniaturizing portable terminals has made it difficult to overcome spatial diversity required between antennas, thus causing a problem in mutual coupling between the antennas due to a narrow deployment distance.

SUMMARY OF THE INVENTION

The present disclosure is contrived in view of the above-mentioned points and one aspect of the present disclosure is to minimize mutual coupling between antennas provided in a limited space and enhance the performance of wireless transmission. Another aspect of the present disclosure is to propose an antenna structure for maximizing spatial and polarization diversity in the limited space, thus facilitating modularization and fabrication of the antenna.

According to an embodiment of the present invention, a portable terminal includes a terminal body, a first antenna provided on a circuit board having a first ground that is used by the first antenna, and an antenna assembly integrated into the terminal body. The antenna assembly includes at least one diversity antenna fed to the circuit board and formed on the circuit board having at least one ground that is independent from the first ground. In one aspect of the present invention, the at least one diversity antenna is formed into an angled configuration with respect to the circuit board.

According to another embodiment of the present invention, an antenna assembly integrated into a case of a portable terminal or wireless modem device includes a first antenna provided at a side of a circuit board having a first ground, a second antenna fed to the circuit board and formed at one lateral surface of the circuit board having a second ground that is independent from the first ground, a third antenna fed to the circuit board and formed at the other lateral surface of the circuit board having a third ground that is independent from the first and second grounds, and a ground extension unit supporting the second and third antennas and connected to the first ground to extend a length of the first ground.

According to yet another embodiment of the present invention, a portable terminal includes a first body having a circuit board and a first antenna formed on the circuit board with a first ground, a second body foldably connected to the first body by a hinge, and a second antenna integrated into the second body, the second antenna including at least one diversity antenna fed to the circuit board and configured to form an angle with respect to the first body, the at least one diversity antenna having a second ground that is independent from the first ground.

BRIEF DESCRIPTION OF THE DRAWINGS

The above and other aspects, features, and advantages of the present invention will become more apparent upon consideration of the following description of preferred embodiments, taken in conjunction with the accompanying drawings.

DETAILED DESCRIPTION OF PREFERRED EMBODIMENTS

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

Figure 1:
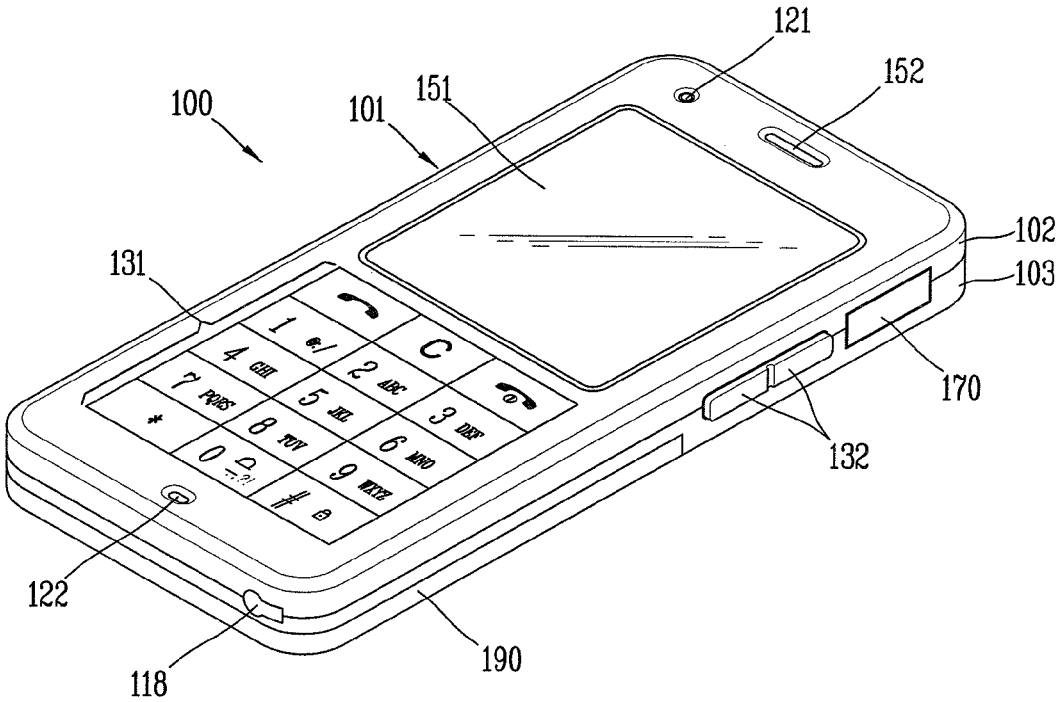
FIG. 1 is a front perspective view of a portable terminal according to an embodiment of the present invention.

As illustrated in FIG. 1, a portable terminal 100 is provided with a terminal body 101. However, the present invention is not limited to a bar-type portable terminal as disclosed in FIG. 1, and may be also applicable to a folder-type by which two terminal bodies are foldably connected to each other, a slide-type by which two terminal bodies are slidably connected to each other, or other types such as a portable terminal having a form factor.

A case, such as a casing, housing, or cover, forming an appearance of the terminal body 101 is formed by a front case 102 and a rear case 103. Various electronic components are integrated in a space formed by the front case 102 and the rear case 103. Furthermore, at least one intermediary case may be additionally disposed between the front case 102 and the rear case 103. Components, such as a first manipulation unit 131, a display unit 151, an audio output unit 152, an image input unit 121, and an audio input unit 122, may be arranged on a front surface of the terminal body 101 as shown in FIG. 1.

The display unit 151 may be a liquid crystal display (LCD) module, an organic light emitting diodes (OLED) module, an e-paper, or a transparent OLED (TOLED) for visually expressing information. Furthermore, the display unit 151 includes a touch sensitive member for receiving information or a control command by the touch of a user. The touch sensitive member may include a transparent electrode film disposed within a display window.

The audio output unit 152 may be implemented in the form of a receiver or loud speaker. The image input unit 121 may be implemented in the form of a camera module for capturing an image or video. The audio input unit 122 is may be implemented in the form of a microphone for receiving the user's voice or other sounds. The display unit 151 or the audio output unit 152 as described above may be provided on another surface of the terminal body 101, for example, at lateral or rear surface of the terminal body 101. Further, The display unit 151 or the audio output unit 152 may be additionally provided on other surface(s) of the terminal body 101.

The first manipulation unit 131 receives a command for controlling the operation of the portable terminal 100. As illustrated in FIG. 1, a second manipulation unit 132, an interface unit 170, and a broadcast signal receiving antenna 118 may be arranged at a lateral surface of the portable terminal 100. In particular, the second manipulation unit 132 may be provided at a lateral surface of the terminal body 101.

The first manipulation unit 131 and the second manipulation unit 132 may be commonly designated as a manipulating portion, and any method involving a tactile input allows the user to manipulate the manipulating portion, providing a tactile feeling. For example, the manipulating portion may be implemented using a dome switch, touch screen, or touch pad capable of receiving a command or information by a user's push or touch manipulation, or may also be implemented using a wheel or jog method for rotating a key or using a method of manipulating a joystick.

From a functional viewpoint, the first manipulation unit 131 is used for inputting information such as numerals, characters, or symbols, and a command for menus such as start and end. The second manipulation unit 132 may operate as a hot-key for carrying out a specific function such as activation of the first image input unit 121 in addition to a scroll function.

The interface unit 170 may serve as a path through which the portable terminal 100 can exchange data with an external device. For example, the interface unit 170 may be implemented as a connection port for connecting an earphone to the portable terminal 100 via a wired or wireless means, a power supply port for supplying power to the portable terminal 100, or a port for short-range communication, such as an Infrared Data Association (IrDA) port, a Bluetooth™ port, or a wireless LAN port. The interface unit 170 may be implemented in the form of a socket for accommodating an external card, such as a Subscriber Identity Module (SIM), a User Identity Module (UIM), or a memory card for storing information.

In addition to an antenna for phone calls, the broadcast signal receiving antenna 118 may be disposed at a side of the terminal body 101. The broadcast signal receiving antenna 118 may be provided in the rear case 103 to be pulled out or to be pulled out and then rotated.

Figure 2:
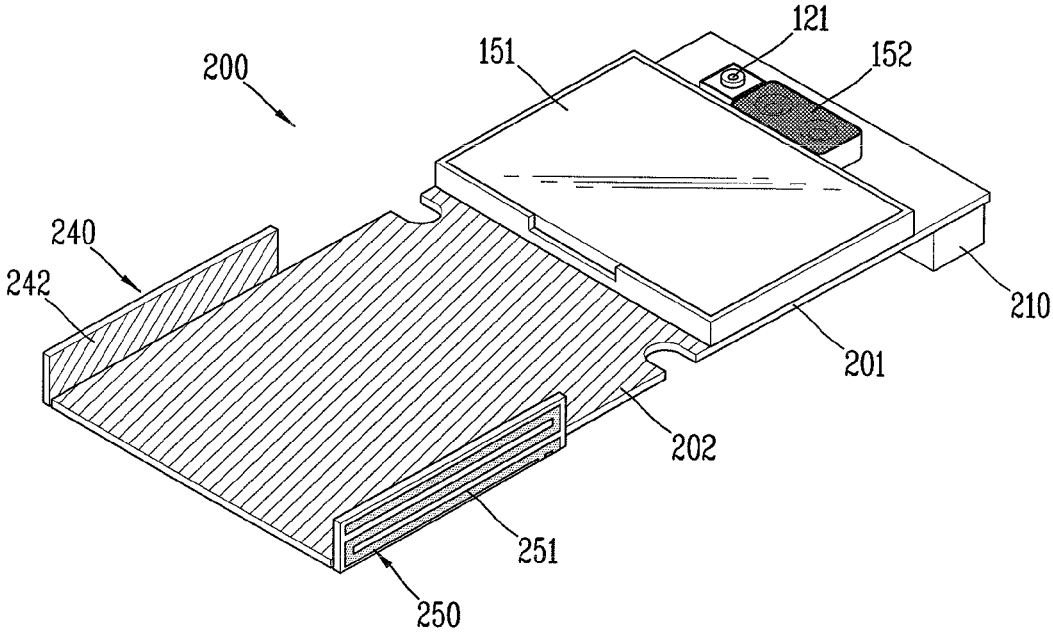
FIG. 2 is a perspective view of a circuit board assembly mounted with an antenna according to an embodiment of the present invention.

FIG. 2 shows a circuit board assembly 200 mounted with an antenna for the portable terminal 100 according to an embodiment of the present invention. As illustrated in FIG. 2, the circuit board 201 integrated in the cases 102, 103 may be mounted together with the display unit 151, the audio output unit 152, and the antenna in an integrated form.

In one aspect of the present invention, the antenna includes a first antenna 210, a second antenna 240, and a third antenna 250. The first antenna 210, which is configured to operate in various wireless communication bandwidths or multi-band provided by the portable terminal 100, is provided at a side of the circuit board 201. The first antenna 210 may be disposed at an end portion of the terminal body 101 in order to minimize interference with other components or hand effects.

The circuit board 201 may be formed in a multi-layer structure when viewed from a lateral surface, or in a plurally-divided structure when viewed from a plane surface. A first ground 202 formed on the circuit board 201 is associated with a length of the circuit board 201 and corresponds to a low band of the bandwidths taken charge by the first antenna 210. The first ground 202 may be extended, as will be described later, to enhance the wireless performance.

The second and the third antennas 240, 250, which are separated from the first antenna 210 by a preset distance, are provided at both lateral surfaces of the circuit board 201. The second and the third antennas 240, 250 may be referred to as a "diversity antenna" in the aspect of implementing the spatial diversity of the first antenna 210. However, the configuration provided with both the second antenna 240 and the third antenna 250 may not be necessarily required, and either of them may be omitted. The first, the second, and the third antennas 210, 240, 250 constitute a smart antenna system for implementing, for example, a multiple input multiple output (MIMO). This antenna system may be suitably used for a portable terminal 100 that requires wireless bulk data processing such as long term evolution (LTE) or high rate packet data (HRPD).

In order to implement MIMO diversity, it is preferable to increase the distance between the second antenna 240 and third antenna 250 with respect to the first antenna 210, but it is difficult to satisfy the above scheme because the internal space of the portable terminal 100 becomes limited due to its reduced size. Moreover, a problem such as mutual coupling may be caused by the reduced distance between the second antenna 240 and third antenna 250 with respect to the first antenna 210.

In order to overcome the above identified problems, the second antenna 240 and the third antenna 250 may have a second ground 242 and a third ground 252 (shown in FIG. 3), which are electrically isolated from the first ground 202 used by the first antenna 210. A chip antenna using a high dielectric substance may be applied to the second antenna 240 and the third antenna 250.

In one aspect the present invention, the second antenna 240 and third antenna 250 may be arranged to form a predetermined angle with respect to the circuit board 201 such that radiation patterns of the second antenna 240 and third antenna 250 have different directivities from a radiation pattern of the first antenna 210, thereby providing excellent polarization characteristics. For example, the second antenna 240 and third antenna 250 are arranged to form an angle of about 90 degrees with respect to the circuit board 201 as illustrated in FIG. 2. In another aspect of the present invention, the second antenna 240 and third antenna 250 are structured to have grounds 242, 252 that are independent from the first ground 202, and may be supported by each board, rigid circuit board or flexible circuit board.

Figure 3:
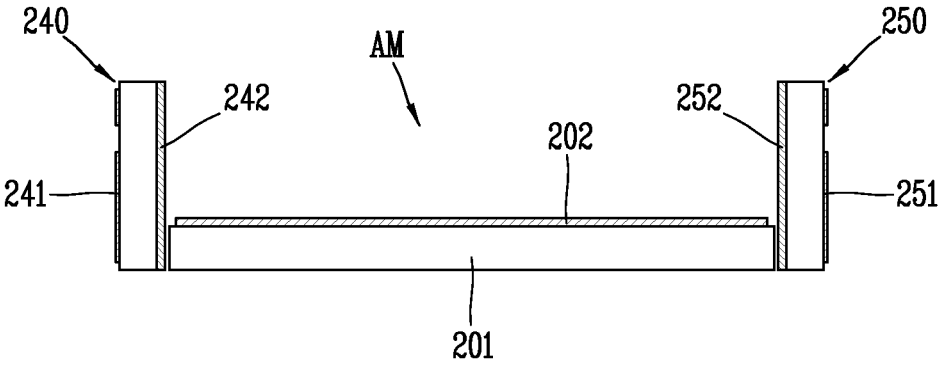
FIG. 3 is a cross-sectional view of an antenna assembly according to an embodiment of the present invention.

The aforementioned structure and arrangement will be described with reference to FIG. 3 showing an antenna assembly (AM) associated with the portable terminal 100 according to an embodiment of the present invention. The first ground 202 directly affecting the radiation characteristics of the first antenna 210 is formed on the circuit board 201. The second antenna 240 and third antenna 250 being fed to the circuit board 201 are formed by being raised at both lateral surfaces of the circuit board 201, and include a first radiator 241, a second radiator 251 and grounds 242, 252, respectively. The second ground 242 of the second antenna 240 and the third ground 252 of the third antenna 250 operate independently from the first ground 202 of the first antenna 210 formed on the circuit board 201, thereby minimizing an effect on the second antenna 240 or the third antenna 250 when operating the first antenna 210.

Figure 4:
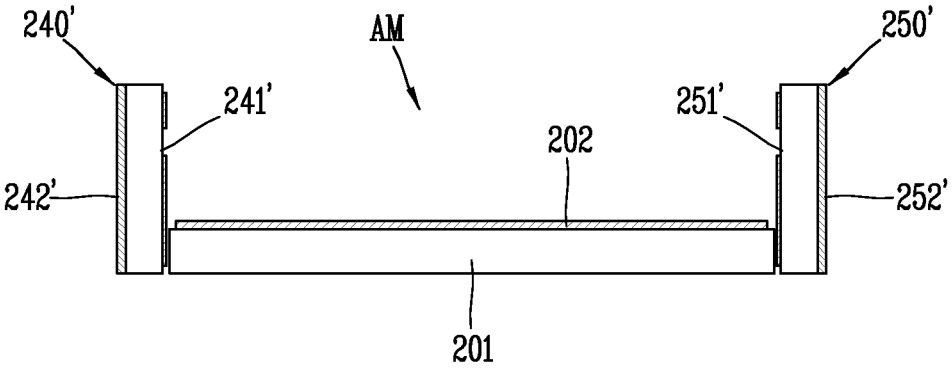
FIG. 4 is a cross-sectional view of an antenna assembly according to another embodiment of the present invention.

FIG. 4 illustrates an antenna assembly (AM) associated with the portable terminal 100 according to another embodiment of the present invention. As illustrated in FIG. 4, the radiators 241', 251' constituting the second antenna 240' and third antenna 250' are positioned at an opposite side of the second ground 242' and third ground 252', respectively.

Figure 5A:
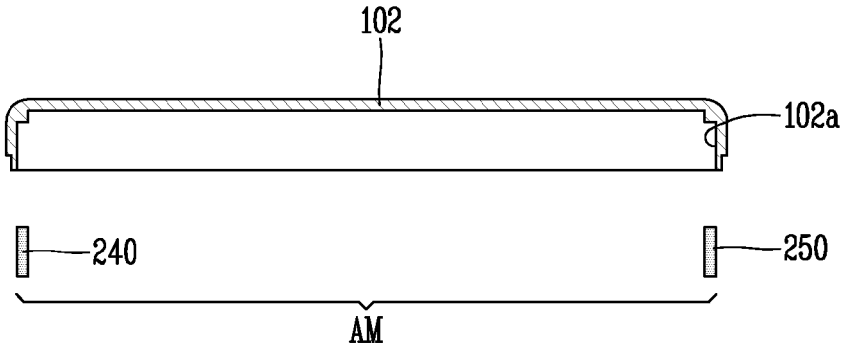
FIGS. 5A through 5C are cross-sectional views illustrating a process of mounting an antenna assembly according to an embodiment of the present invention.
Figure 5B:
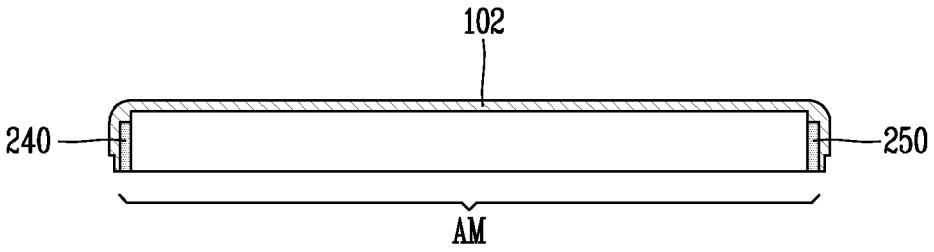
Figure 5C:
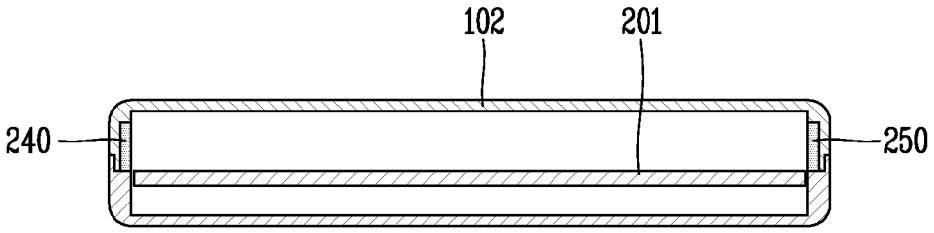

FIGS. 5A through 5C illustrate a process of mounting an antenna assembly (AM) according to an embodiment of the present invention. The second antenna 240 and third antenna 250 may be formed directly on the front case 102. In other words, an antenna attachment unit 102*a* is formed on the front case 102 as illustrated in FIG. 5A, the second antenna 240 and third antenna 250 are attached to each antenna attachment unit 102*a* as illustrated in FIG. 5B, and the circuit board 201 is isolated from the grounds of the second antenna 240 and third antenna 250 as illustrated in FIG. 5C.

Therefore, the second antenna 240 or the third antenna 250 may be directly attached to the front case 102 and thus, handled as a case-integrated module. Such case-integrated module facilitates handling and assembly of the antenna assembly (AM) and may reduce the fabrication cost compared to a case where the second antenna 240 and third antenna 250 are independently fixed to lateral surfaces of the circuit board 201.

Figure 6:
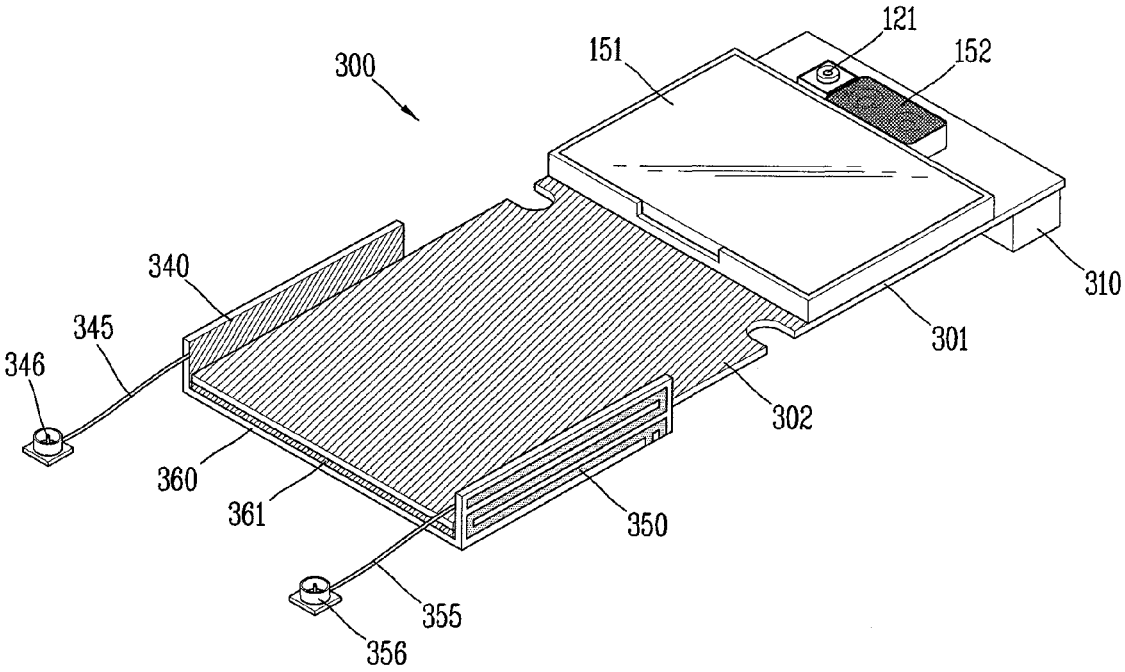
FIG. 6 is a perspective view of a circuit board assembly according to another embodiment of the present invention.

FIG. 6 illustrates a circuit board assembly 300 according to another embodiment of the present invention. As illustrated in FIG. 6, a second antenna 340 and a third antenna 350 include a structure 360 for connecting to a circuit board 301. Radio signals received or radiated via the second antenna 340 are transmitted through antenna transmission line units 345, 355 and connectors 346, 356. The antenna transmission line units 345, 355 are adhered to the second antenna 340 and the third antenna 350, respectively, formed in the form of a coaxial cable or flexible circuit board, and connected to a relevant position of the circuit board 301.

Referring to FIG. 6, the second antenna 340 and third antenna 350 are fixed to a separate structure 360 for supporting them. In one aspect of the present invention, the structure 360 is a flexible circuit board. A ground extension unit 361 made of a conductive material is mounted at the separate structure 360. The ground extension unit 361 is used to solve a problem of securing a sufficient length due to the miniaturization of the circuit board 301, and connected to a first ground 302 of the circuit board 301 in order to extend the length of the first ground 302. As a result, the wireless characteristics can be enhanced, particularly at the low band. The ground extension unit 361 may be arranged to be apart from the circuit board 301 by a predetermined gap and other components or elements may be arranged within the gap.

Figure 7A:
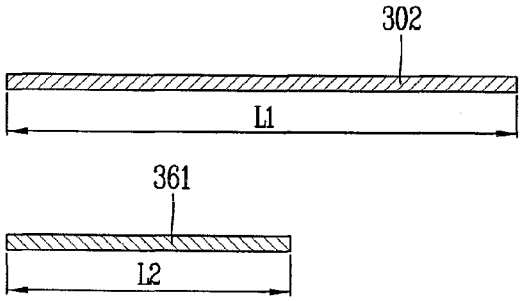
FIGS. 7A and 7B illustrate a structural relationship of two components of the circuit board assembly shown in FIG. 6.
Figure 7B:
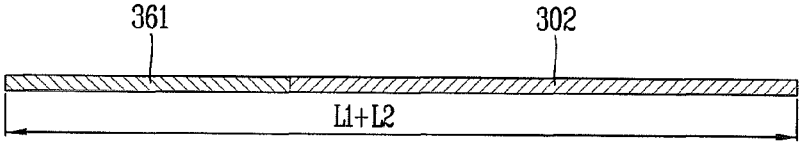

Referring to FIG. 7A, when a length of the first ground 302 on the circuit board 301 as illustrated in FIG. 6 is "L1," and a length of the ground extension unit 361 is "L2," the second antenna 340 according to this embodiment is able to obtain an effect of summing L1 and L2 as shown in FIG. 7B.

Figure 8A:
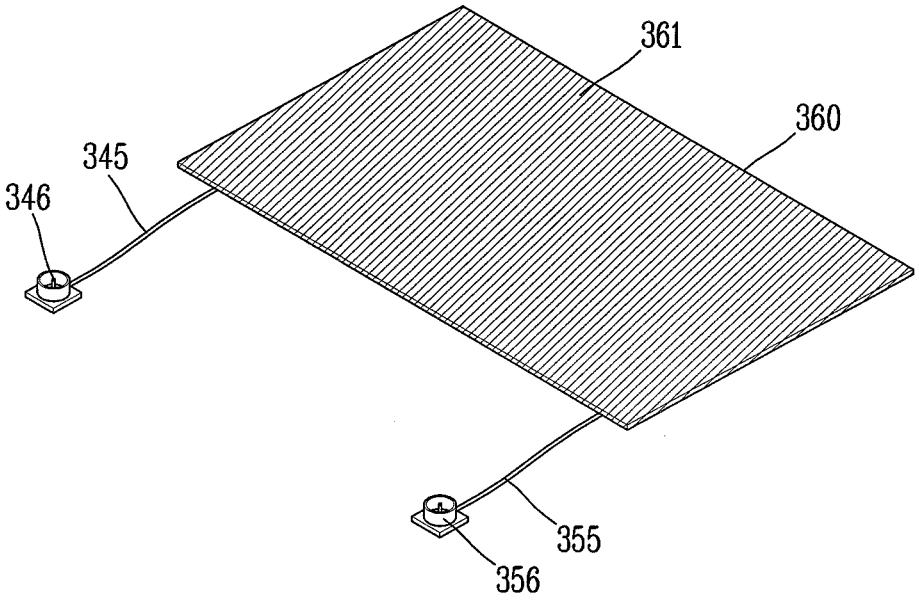
FIGS. 8A through 8E illustrate a process of mounting an antenna assembly associated with the circuit board assembly shown in FIG. 6.

FIGS. 8A through 8E illustrate a process of mounting an antenna assembly (AM) illustrated in FIG. 6. Referring to FIG. 8A, the second antenna 340 and third antenna 350 are mounted by using the ground extension unit 361, which is formed as a flexible circuit board 360. First, a flexible circuit board 360 having at least one conductive layer over an overall surface of the flexible circuit board 360 is prepared as illustrated in FIG. 8A. A first antenna transmission line unit 345 and a second antenna transmission unit 355 for feeding to the second antenna 340 and third antenna 350 are connected to the flexible circuit board 360.

Figure 8B:
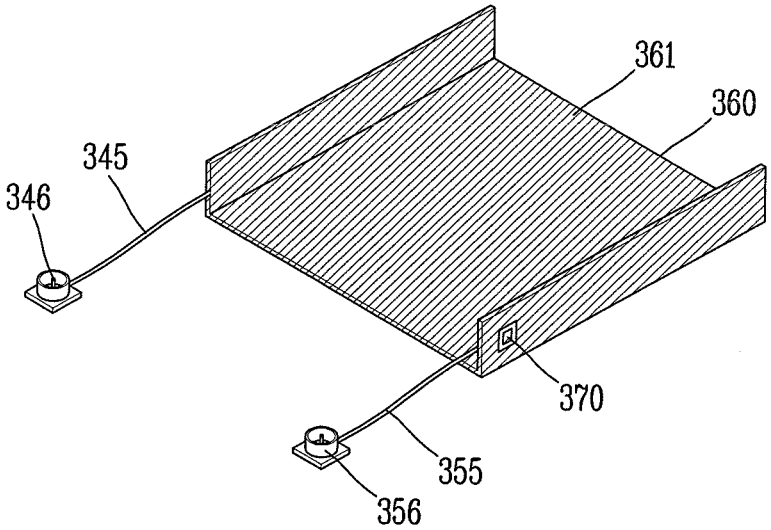

As illustrated in FIG. 8B, the flexible circuit board 360 includes a pad 370 for connecting a feeding portion 347 (shown in FIG. 8C) of the second antenna 340 and a feeding portion 347 of the third antenna 350 such that the flexible circuit board 360 is attached to the second antenna 340 and third antenna 350 via the pad 370. The second antenna 340 and third antenna 350 may form a predetermined angle with respect to the circuit board 301.

Figure 8C:
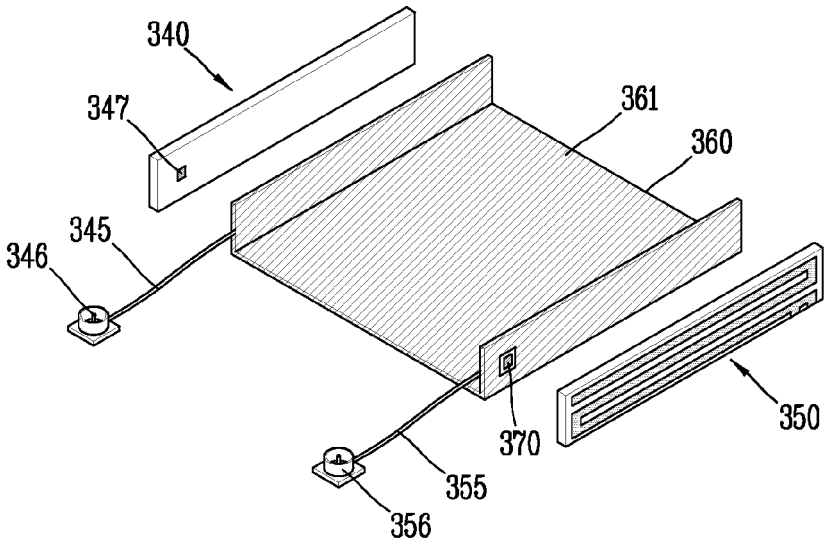
Figure 8D:
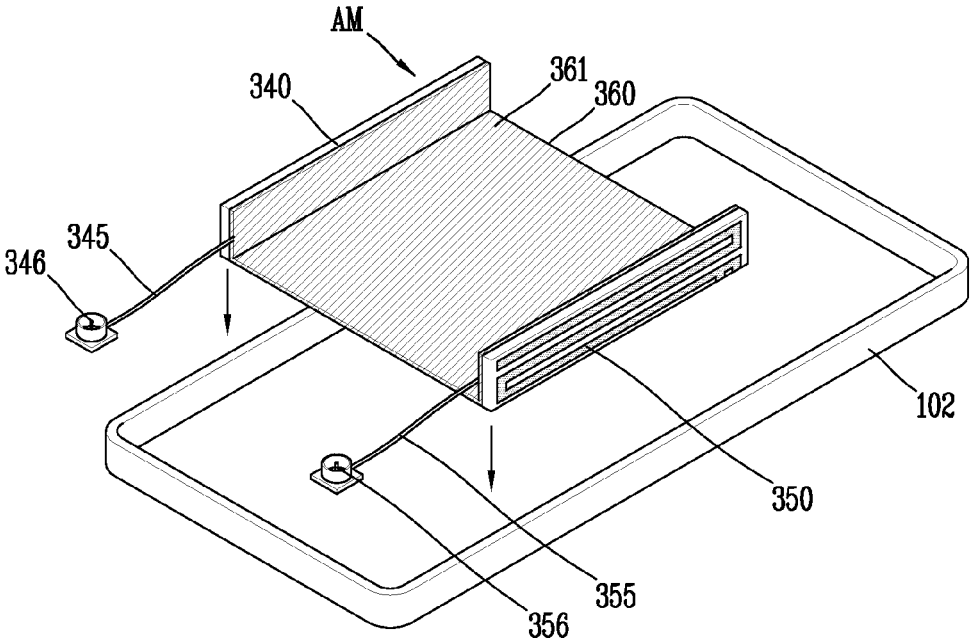
Figure 8E:
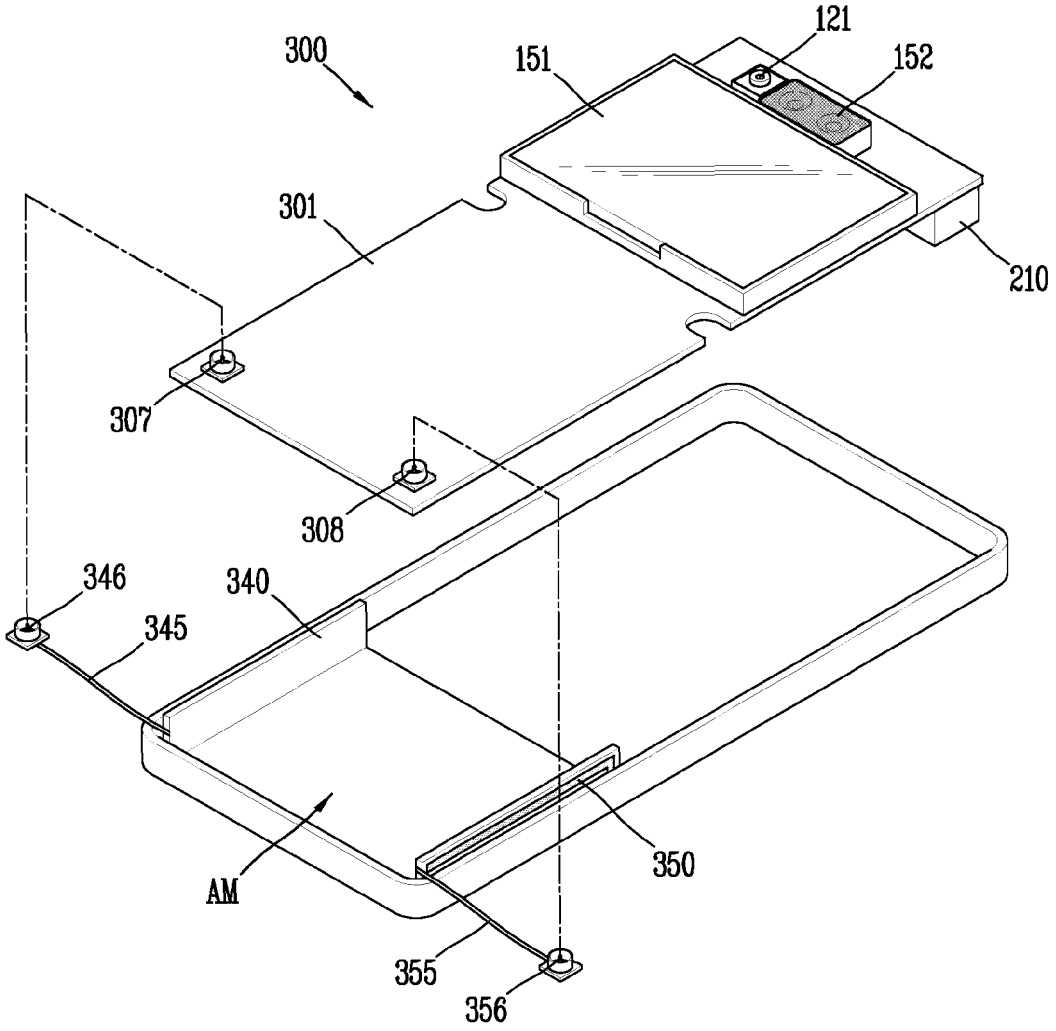

Next, as illustrated in FIG. 8C, the second antenna 340 and third antenna 350 having independent grounds are attached to the flexible circuit board 360. The flexible circuit board 360 combined with the second antenna 340 and third antenna 350 is mounted in the front case 102 as illustrated in FIG. 8D, and the connectors 346, 356 of the antenna transmission line units 345, 355 are connected to receptacles 307, 308 formed on the circuit board 301 when the circuit board assembly 300 is arranged in the front case as shown in FIG. 8E.

According to an antenna structure obtained by this manner, the second antenna 340 or the third antenna 350 having a ground independent from the first antenna 310 (shown in FIG.

6) is used as a diversity antenna, thereby improving the isolation characteristics between antennas. Moreover, it may be possible to minimize the deterioration of the wireless characteristics. As a result, it may be used in a portable terminal 100 that requires high data processing capacity such as LTE or HRPD.

Figure 9:
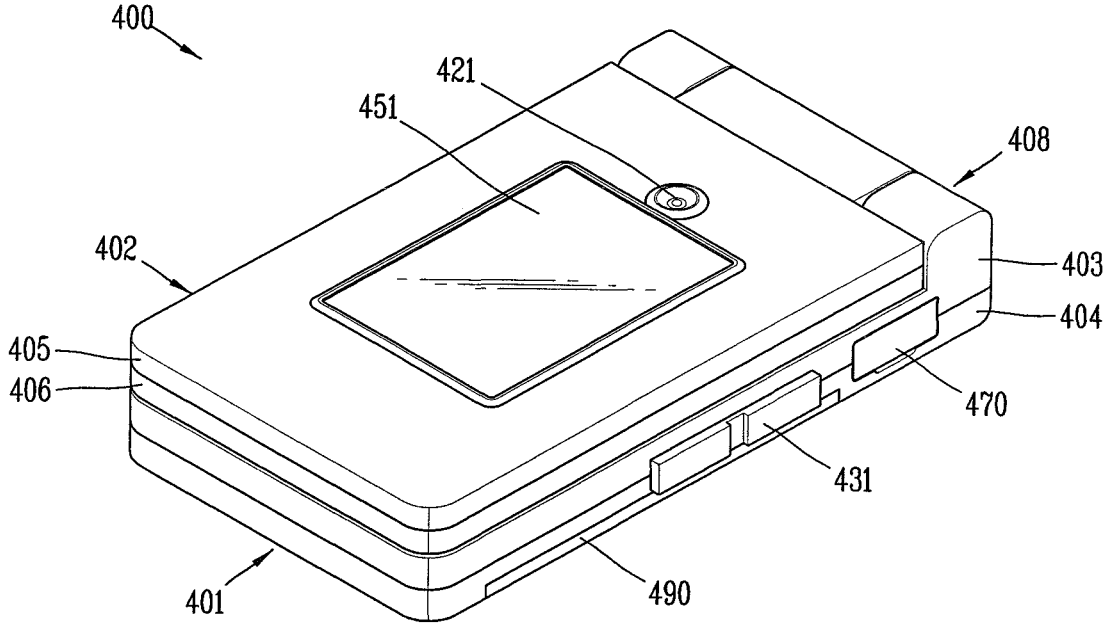
FIG. 9 is a perspective view a folder-type portable terminal having an antenna assembly in a closed state according to an embodiment of the present invention.

Referring to FIG. 9, a folder-type portable terminal 400 includes a first body 401 and a second body 402 foldably connected to each other. A state in which the two bodies 401, 402 are completely folded as illustrated in FIG. 9 may be referred to as a closed configuration, and a state in which the inner surfaces of the first body 401 and second body 402 are exposed by rotating the second body 402 by a predetermined angle with respect to the first body 401, as illustrated in FIG. 10, may be referred to as an open configuration.

A display unit 451 for displaying various state information or contents desired by a user in the closed configuration may be provided on an outer surface of the second body 402. A first image input unit 421 is provided on a portion of the outer surface of the second body 402. The first image input unit 421 may be configured to capture the user's own image by means of the display unit 451 without opening the second body 402.

Figure 10:
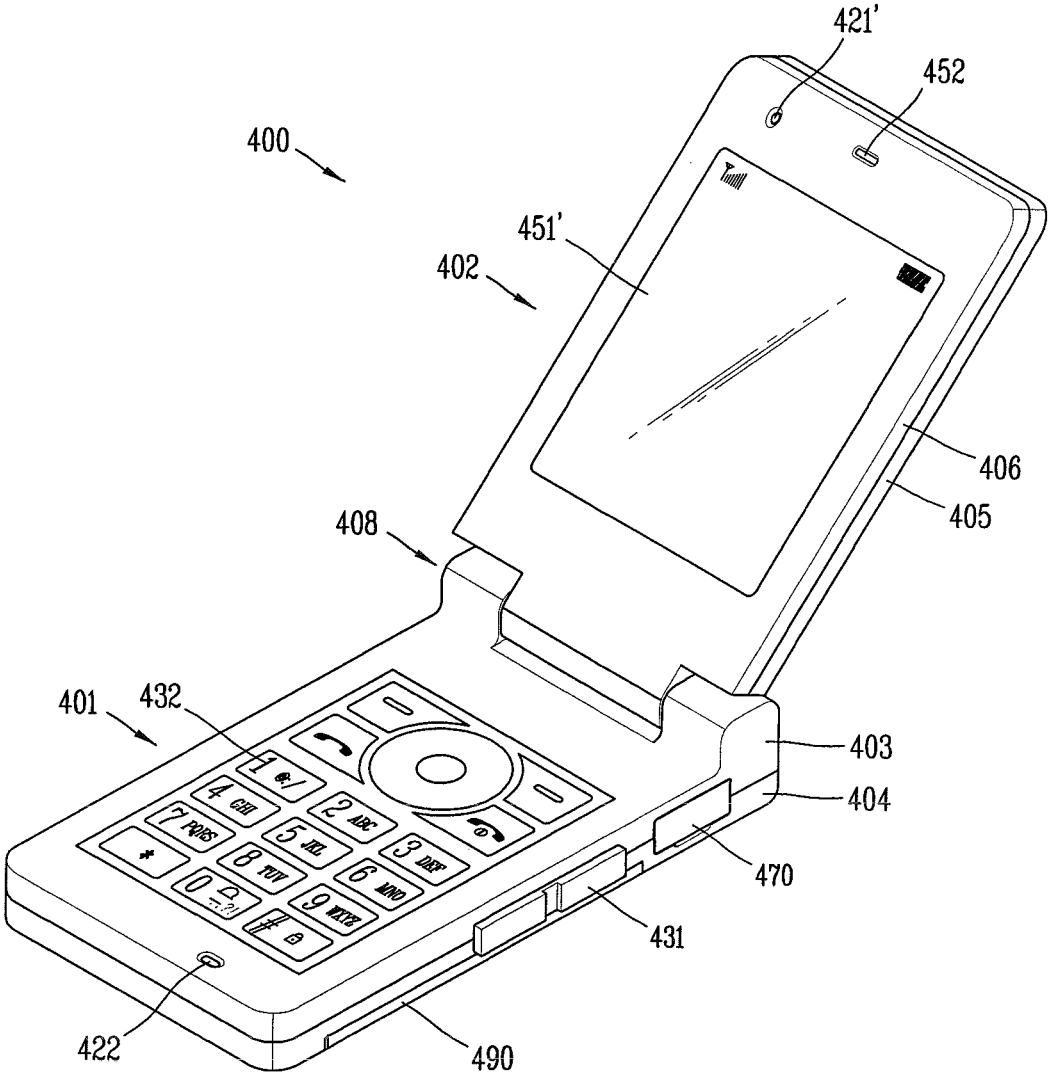
FIG. 10 is a perspective view of the folder-type portable terminal shown in FIG. 9 in an open state.

Referring to FIG. 10, an audio output unit 452, a second image input unit 421', and a second display unit 451' are provided at an inner surface of the second body 402. The second image input unit 421' may be implemented in the form of a camera module for capturing an image or video or performing a video call. Moreover, an additional image input unit (not shown) may be provided on a rear surface of the first body 401 to capture an object positioned at an opposite side of the user.

The second display unit 451' may be suitable to provide a wider screen than a screen of the first display unit 451. Further, the screen of the second display unit 451' may output images in different orientations based on the posture of the portable terminal 400. A keypad 432 and an audio input unit 422 may be mounted on an inner surface of the first body 401, and a side key 431 and an external interface 470 may be provided at a lateral surface of the first body 401.

As illustrated in FIGS. 9 and 10, the first body 401 is connected to the second body 402 by means of a hinge 408. The hinge 408 allows the second body 402 to be positioned at a specific angle with respect to the first body 401, for example, open configurations such as about 130 degrees for phone calls or 90 degrees for image capturing. An elastic unit 409 for controlling an open angle of the second body 402 by elasticity, as shown in FIG. 11 or a stopper device for adjusting a stoppage angle of the second body 402 may be provided for the hinge 408.

Figure 11:
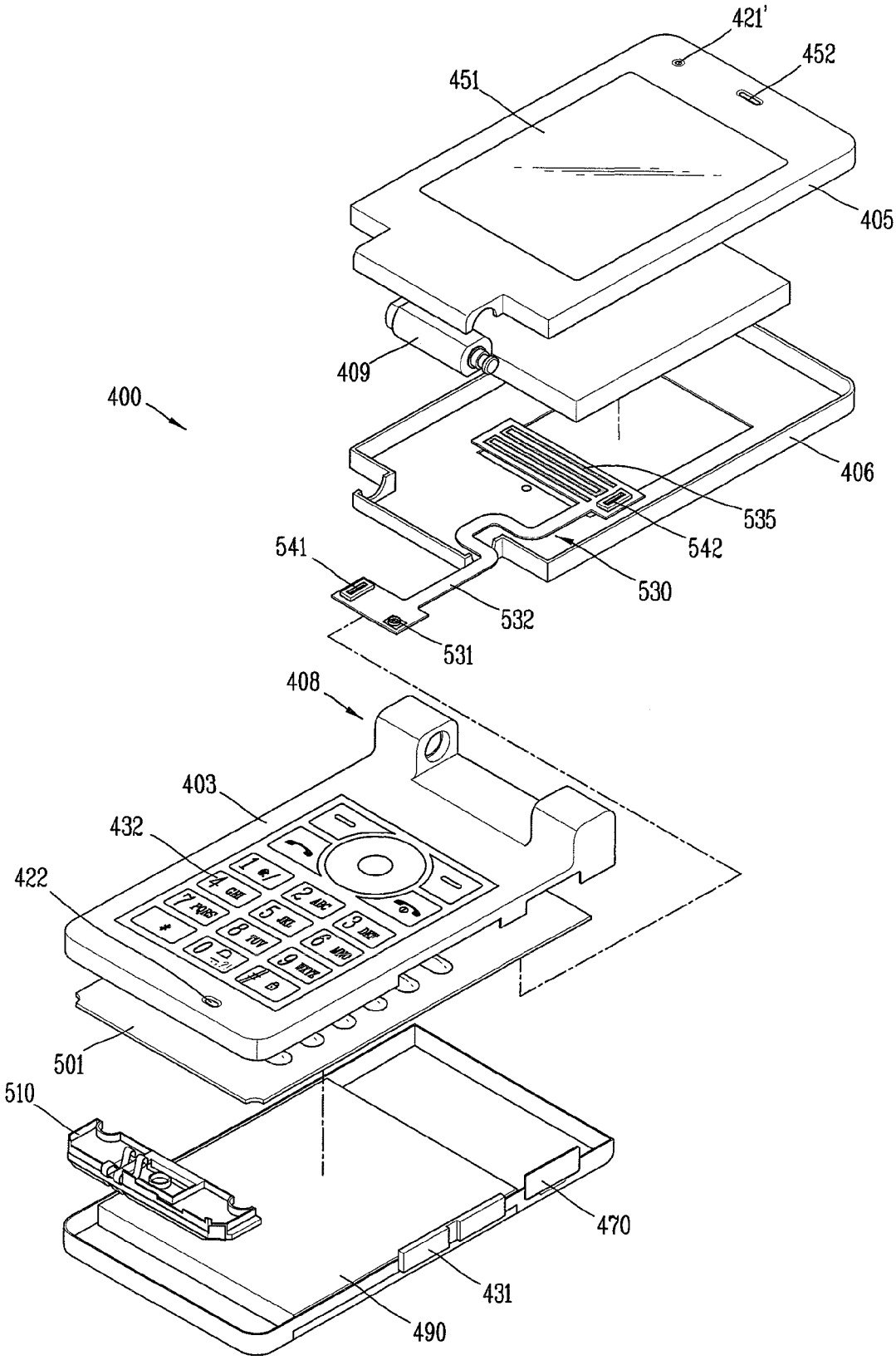
FIG. 11 is an exploded perspective view of the portable terminal shown in FIGS. 9 and 10.

Referring to FIG. 11, a circuit board 501 mounted with various components such as a processor including a wireless processing module, is provided within the first body 401. The circuit board 501 may be formed in a multi-layer structure when viewed from a lateral surface, or in a plurally-divided structure when viewed from a plane surface.

A first antenna 510 is provided on the circuit board 501 at an opposite side of the hinge 408. The first antenna 510 may be configured to operate in various wireless communication bandwidths provided by the portable terminal 400. The first antenna 510 may be disposed at an end portion of the first body 401 in order to minimize interference with other components or hand effects. The first antenna 510 may be formed in various modified forms including a press-type as illustrated in FIG. 3 such that a radiator is pressed and fixed on the surface of a dielectric carrier.

Another antenna fed to the circuit board 501 is a second antenna 530 in which a radiator 535 is arranged at the second body 502. The first antenna 510 and the second antenna 530 constitute a smart antenna system for implementing a multiple input multiple output (MIMO). The radiator 535 of the second antenna 530 is not spatially placed together with the first antenna 510 within the first body 401, but placed at the second body 402 such that spatial diversity is implemented with regard to the first antenna 510.

The second antenna 530 may include a plug 531, a flexible PCB 532, and the radiator 535. The plug 531 is formed to be inserted into the circuit board 501 and a signal of the radiator 535 may be fed to the circuit board 501 by the plug 531. The plug 531 may be configured to be inserted into a mobile switch (not shown) provided in the circuit board 501. In this case, it is not required to provide a separate receptacle structure for connecting the plug 531, thereby saving the space in order to design a small-sized portable terminal 400.

The flexible PCB 532 is configured to pass through the hinge 408, which provides a narrow path for mechanically connecting the first body 401 with the second body 402, and maintains a stable connection during repetitive opening and closing operations of the second body 402. The flexible PCB 532 provides a stable feeding structure for the radiator 535 as well as facilitating the fabrication and assembly of the radiator 535.

Further referring to FIG. 11, the radiator 535 is formed directly on the flexible PCB 532. In other words, the radiator 535 is formed with a specific pattern by using a copper film on the flexible PCB 532 such that the radiator 535 and the flexible PCB 532 are in an integrated form. In this case, the second antenna 530 is formed during a process of fabricating the flexible PCB 532, and therefore, a connection or feeding structure, which is required when the second antenna 530 is placed separately from the flexible PCB 532, can be omitted. Such fabrication method is advantageous with respect to the number of components and cost.

As an example using the present invention, a circuit board 501, a display unit 451 of the second body 402, and connectors 541, 542 for connecting other components may be formed on the flexible PCB 532. In other words, using the feature of a flexible PCB 532 by which multiple layers can be easily formed, a feeding structure of the second antenna 530 is combined with an electrical connection structure of the second body 402. As a result, it is advantageous for reducing the number of components and reducing the fabrication and assembly time and cost.

Figure 12:
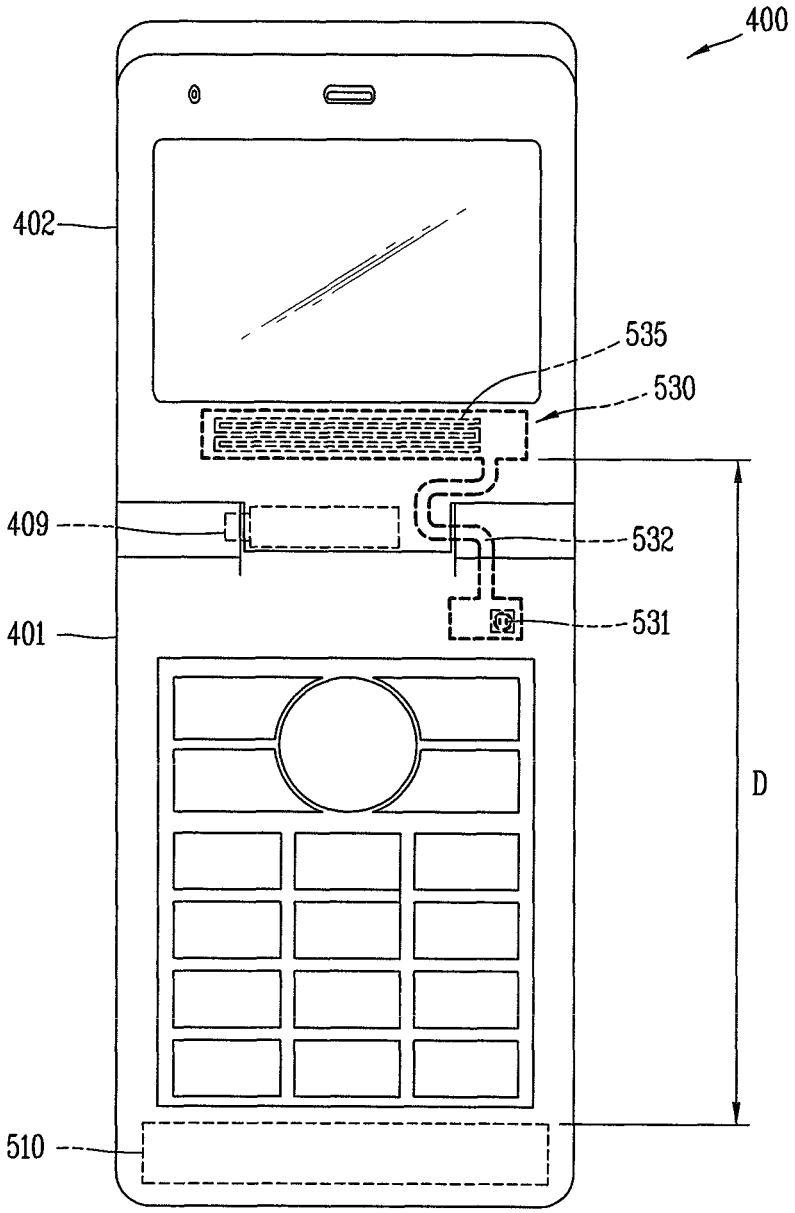
FIG. 12 is a schematic front view of the portable terminal shown in FIGS. 9 and 10.

FIG. 12 schematically illustrates the portable terminal 400 shown in FIGS. 9 and 10. The second antenna 530 is not arranged in the first body 401 that has a limited length but is arranged in the second body 402, thereby securing a predetermined distance (D) from the first antenna 510. When the installation space of an antenna becomes more limited due to the trend of miniaturizing the portable terminal 400, the above described arrangement of the first antenna 510 and the second antenna 530 can provide a structure for reducing mutual coupling and implementing spatial diversity.

The radiator 535 constituting the second antenna 530 may be also formed at a lower end of the first body 401 as shown in FIG. 12 or alternatively, the radiator 535 may be formed at an upper end of the first body 401 in order to increase the distance from the first antenna 510. The flexible PCB 532 constituting the second antenna 530 may be arranged at an opposite side of the elastic unit 409 providing elasticity during the rotation of the second body 402 on the hinge 408 as illustrated in FIG. 12, or alternatively, both the flexible PCB 532 and the elastic unit 409 may be arranged at the same side in order to save the space.

Figure 13:
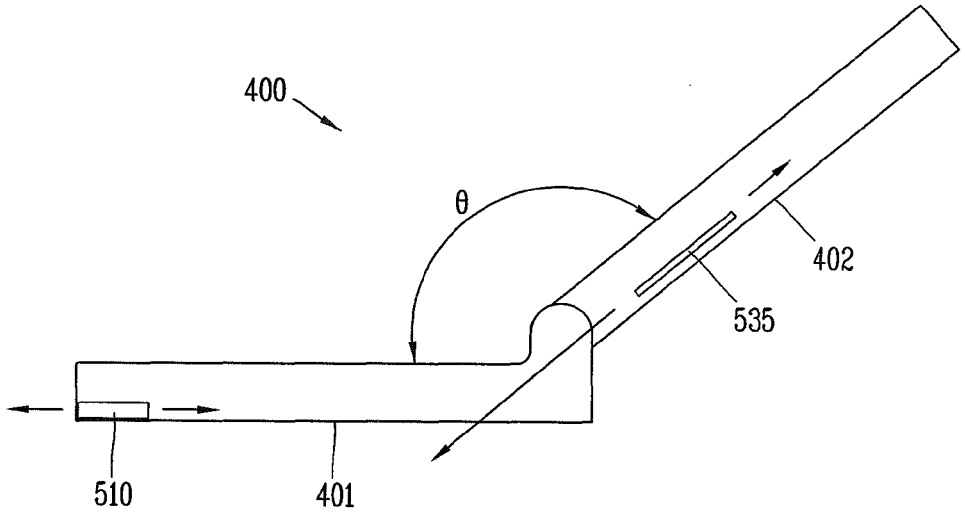
FIG. 13 is a conceptual diagram schematically illustrating a radiation direction of antennas in the portable terminal shown in FIGS. 9 and 10 in the open state.

FIG. 13 is a conceptual diagram schematically illustrating a radiation direction of antennas when the portable terminal 400 shown in FIGS. 9 and 10 is in the open configuration. The radiator 535 of the second antenna 530 forms a preset angle (θ) with respect to the first antenna 510. According to this arrangement, a preset angle (θ) is formed between a radiation direction of the first antenna 510 propagating in parallel to the first body 401 and a radiation direction of the second antenna 530 propagating in parallel to the second body 402. As a result, a polarization characteristic of the first antenna 510 is isolated from a polarization characteristic of the second antenna 530, thereby enhancing the wireless characteristics. This arrangement may be effectively applicable to a portable terminal 400 that requires high data processing capacity such as LTE or HRPD.

Figure 14:
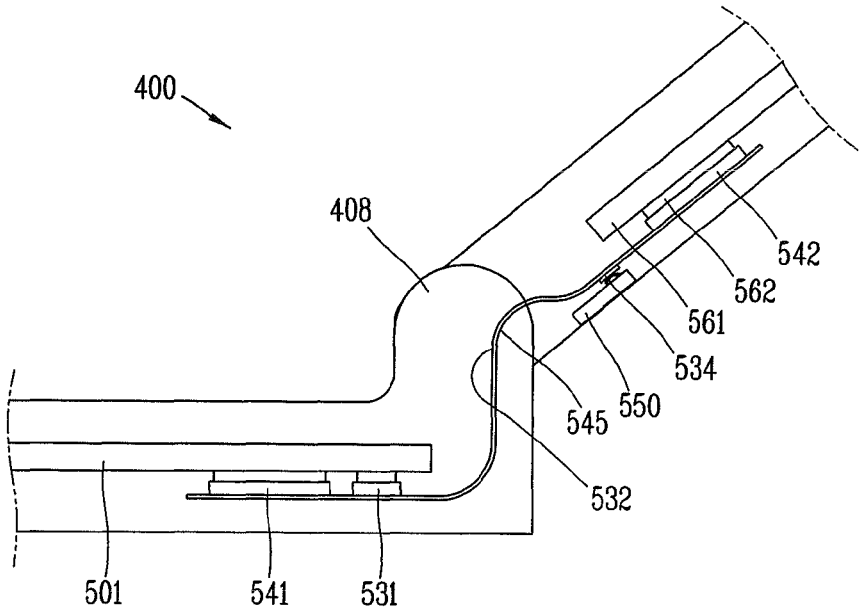
FIG. 14 is a cross-sectional view schematically illustrating a portable terminal according to another embodiment of the present invention.

FIG. 14 schematically illustrates a portable terminal according to another embodiment of the present invention. Referring to FIG. 14, the radiator 535 of the second antenna 530 is configured to contact with an antenna connection unit 534 that is formed on the flexible PCB. In this case, the radiator 535 may be configured in the form of a chip antenna that has a small volume in a different manner from FIG. 11 or a press-type antenna as described above. The flexible PCB includes a first flexible PCB 532 for connecting to the second antenna 530 and a second flexible PCB 545 for connecting to a display module 561.

The first flexible PCB 532 has a first connector 542 on its first end which is adapted to be plugged into a connector 562 of the display module 561, and second connector 531 on its opposite end which is adapted to be connected to the circuit board 501. The second flexible PCB 545 has a pad 534 to which an elastic conductor of a press-type antenna 550 may contact. The second flexible PCB 545 also has a connector 541 which is adapted to feed the antenna 550 to the circuit board 501.

Figure 15:
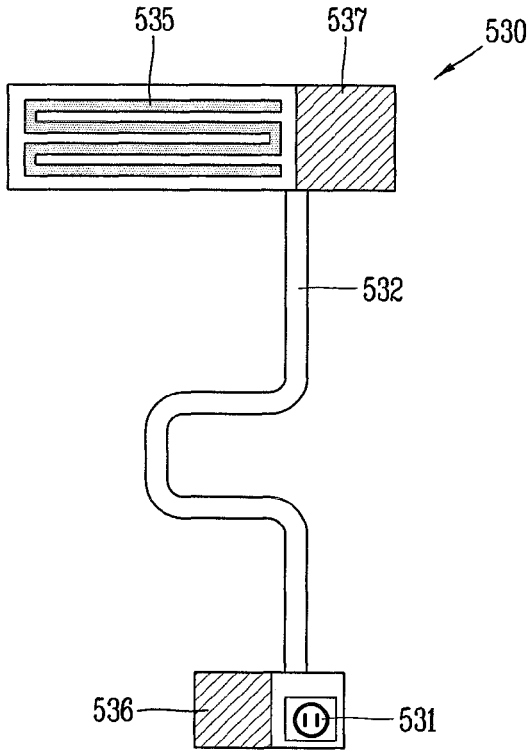
FIG. 15 is a plan view illustrating a second antenna according to an embodiment of the present invention.

FIG. 15 illustrates a second antenna 530 according to an embodiment of the present invention. The second antenna 530 formed with the flexible PCB 532 may include an area of the ground on its own board. As illustrated in FIG. 15, the second antenna 530 includes a first body-side ground 537 that is formed at a side of the radiator 535 and a second body-side ground 536 that is formed at a side of the plug 531. The arrangement of the ground planes 536, 537 can maximize the use of the flexible PCB 532 which facilitates the insulating lamination. However, the shape, arrangement, or size of the first body-side ground plane 537 and second body-side ground plane 536 may be modified. Moreover it is possible to have a configuration in which either the first body-side ground plane 537 or second body-side ground plane 536 is omitted. The grounds 537, 536 formed on the flexible PCB 532 can enhance the wireless characteristics of the radiator 535, and it is advantageous with respect to fabrication and cost, compared to a case in which the grounds are formed on other portions of the second body 402.

Figure 16:
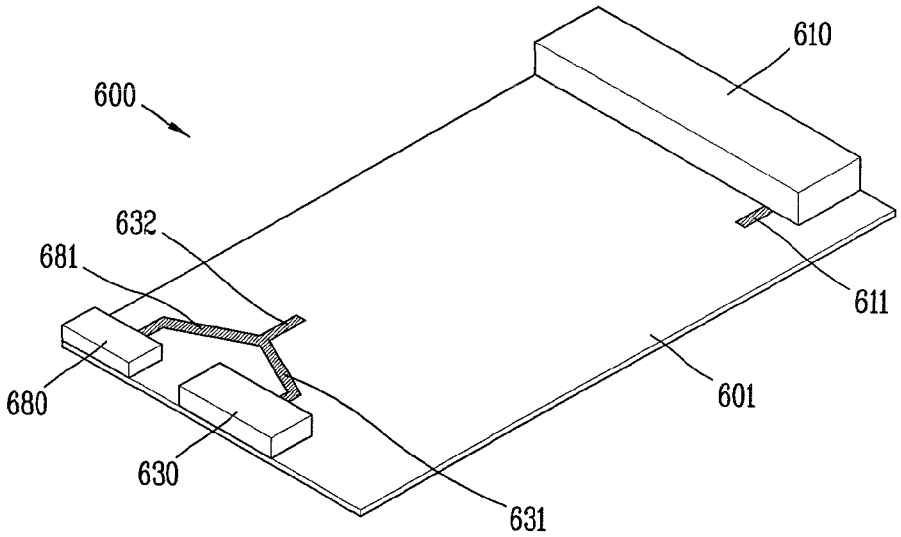
FIG. 16 is a perspective view illustrating an antenna system according to another embodiment of the present invention.

FIG. 16 schematically illustrates an antenna system according to another embodiment of the present invention. The antenna system 600 illustrated in FIG. 16 is a smart antenna for MIMO and includes a plurality of antennas 610, 630, 680. The first antenna 610 is formed such that it is fed by a first feeding path 611 and transmits and/or receives at multiple bandwidths, and the second antenna 630 and third antenna 680, taking charge of a similar bandwidth as the first antenna 610, are separated by a predetermined distance with respect to the first antenna 610 when grouped together.

The first antenna 610 may be configured as an antenna taking all charge of a plurality of wavelengths. The second antenna 630 may be configured as an antenna taking charge of relatively long wavelengths, for example, a bandwidth of about 700-800 MHz. The third antenna 680 may be configured as an antenna taking charge of relatively short wavelengths, for example, a bandwidth of about 1900 MHz.

The second antenna 630 may be implemented by using a flexible PCB-type or press-type antenna in order to cover a low bandwidth. The third antenna 680 may be implemented in the form of a chip antenna having a high dielectric constant, for example, a flexible PCB-type or press-type antenna.

The second antenna 630 is connected to a first feeding portion 631 that is optimized for the second antenna 630 and the third antenna 680 includes a second feeding portion 681 that is optimized for the third antenna 680. The first feeding portion 631 and the second feeding portion 681 join at one point to form a second feeding path 632 such that maximum performance can be achieved in a limited space by the first, the second, and the third antennas 610, 630, 680, generating a resonant frequency by combining the second antenna 630 with the third antenna 680.

While the second antenna 630 and the third antenna 680 are apart from each other on the circuit board 601 in FIG. 16, it is also possible to have the second antenna 630 and third antenna 680 overlap with each other by arranging the third antenna 680 within the region of the second antenna 630. In this case, the mounting area of the antennas can be reduced and thus, the portable terminal 100 can be miniaturized accordingly. It may be possible to use the second antenna 630 having a dielectric constant of 1-4 and the third antenna 680 having a high dielectric constant, for example of 6-20.

According to an embodiment of the present invention, in case of an LTE (Long Term Evolution) system, it may be possible to satisfy conflicting requirements, such as the increased mounting area for multiple antennas and the miniaturization of a terminal when addition of an antenna for implementing a MIMO technology, designing of a larger-sized terminal due to CDMA_AWS Band, or addition of a transmission antenna for CDMA EVDO_A may be necessary. In addition, due to combining of the different antennas 630, 680 with each other, it may be regarded as a kind of "hybrid" antenna.

Figure 17:
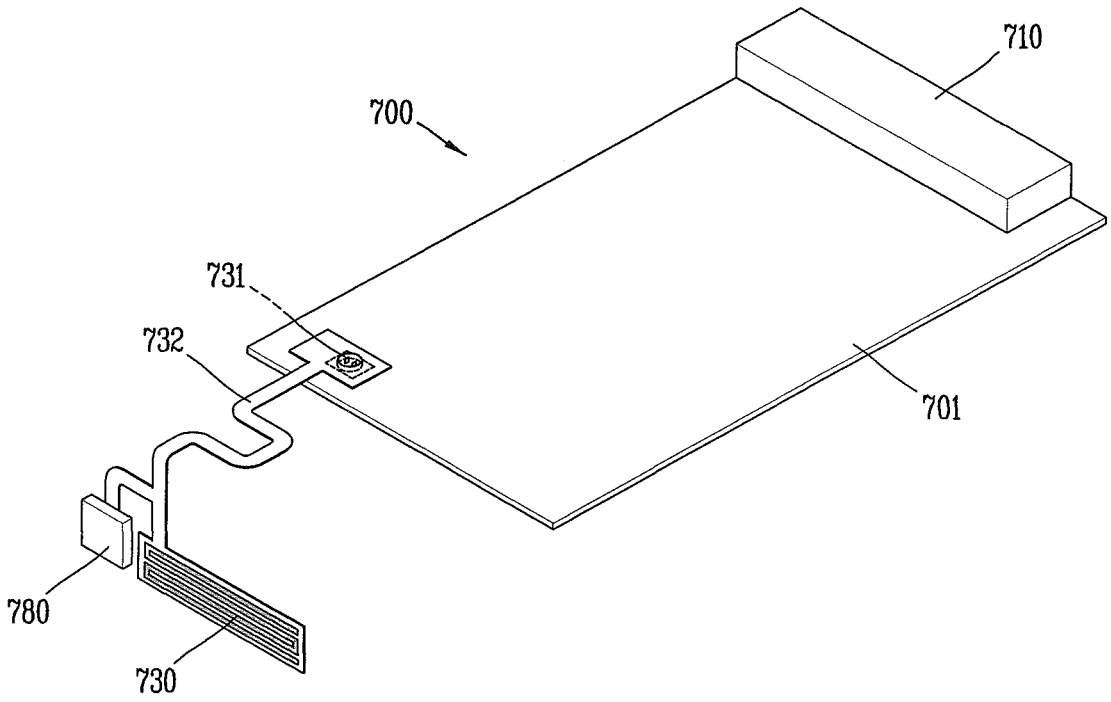
FIG. 17 is a perspective view illustrating an antenna system according to yet another embodiment of the present invention.

FIG. 17 illustrates an antenna system 700 that can be applied to a folder-type portable terminal according to an embodiment of the present invention. Referring to FIG. 17, while a first antenna 710 may be fed directly to a circuit board 701, a second antenna 730 and a third antenna 780 are provided in a body that is different from the one being positioned by the circuit board 701. The second and the third antennas 730, 780 are connected through a flexible PCB 732, with the second antenna 730 being formed directly on the flexible PCB 732 and the third antenna 780 being implemented in the form of a chip, for example. The flexible PCB 732 is plugged to the circuit board 701 through a connector 731. The arrangement of such antennas 710, 730, 780 facilitates a hybrid antenna system providing advantageous spatial diversity and polarization diversity, thus maximizing the wireless performance of the portable terminal 100.

Figure 18:
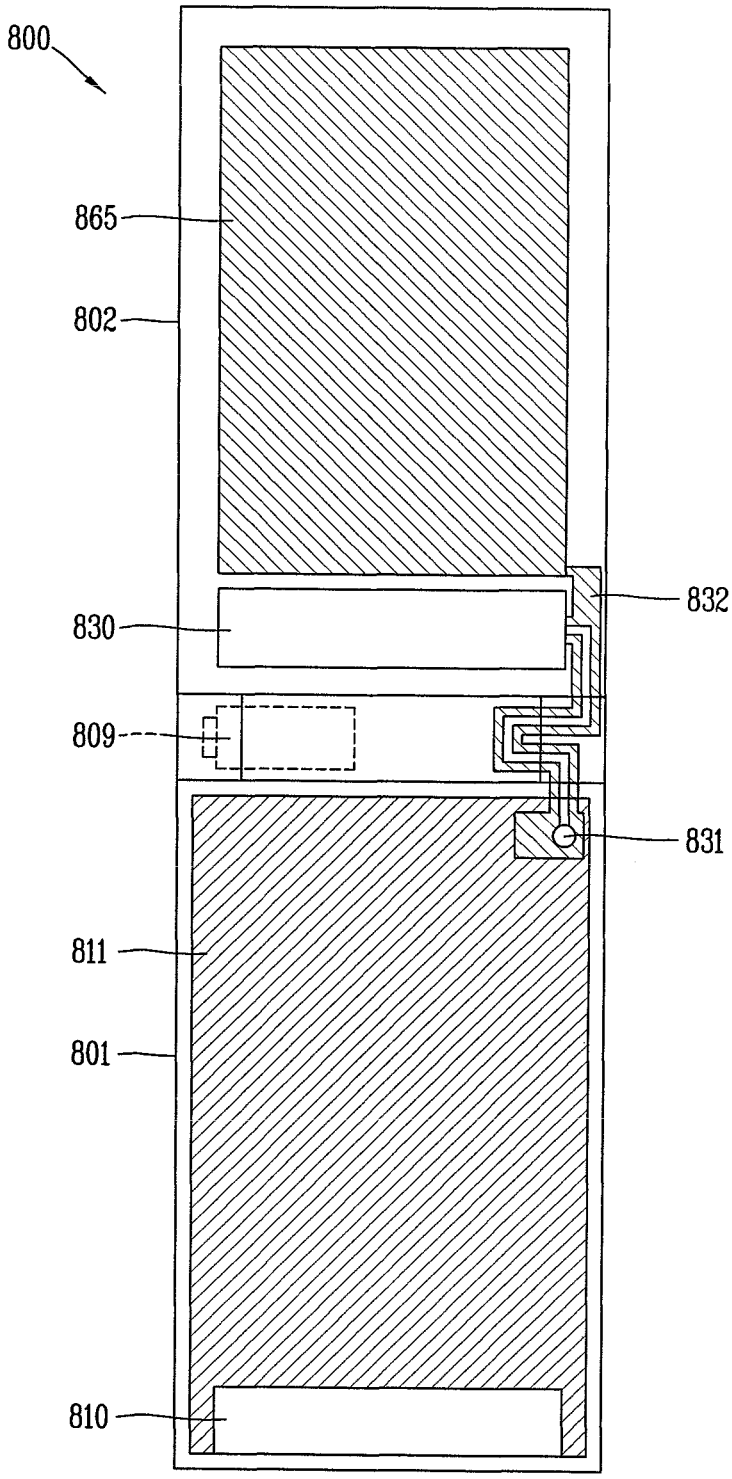
FIGS. 18 through 23 are schematic plan views illustrating a folder-type portable terminal having an antenna system according to various embodiments of the present invention.

FIGS. 18 through 23 illustrate various embodiments of a folder-type portable terminal having an antenna system associated with the present invention. As illustrated in FIG. 18, a portable terminal 800 includes a first body 801 and a second body 802 foldably connected to the first body 801 by a hinge 809.

The first body 801 includes a first ground 811, and a first antenna 810 is provided at a lower end of the first body 801. A display unit 802, for example, an LCD, is arranged on the second body 802 and an LCD frame 865 made of a metal constitutes the display unit 802.

A flexible PCB 832 for connecting the first body 801 to the second body 802 may be arranged on the same side or the opposite side of the hinge 809. For example, the flexible PCB 832 may positioned at an opposite side of the hinge 809 as shown in FIG. 18.

A second antenna 830 for implementing the diversity of the first antenna 810 is arranged within the second body 802 and fed to the first body 801 by the flexible PCB 832 and a connector 831. A signal feeding portion of the second antenna 830, which is arranged at a lower end of the second body 802, is provided within the flexible PCB 832.

The second antenna 830 has a second ground that is separate from a first ground 811 of the first body 801. The second ground is used in order to enhance the wireless characteristic of the second antenna 830. For example, the LCD frame 865 that is connected to the flexible PCB 832 is used as the second ground of the second antenna 830, as shown in FIG. 18. The area of the LCD frame 865 can be used effectively to minimize of the number of components, which may be separately required to extend the ground.

Figure 19:
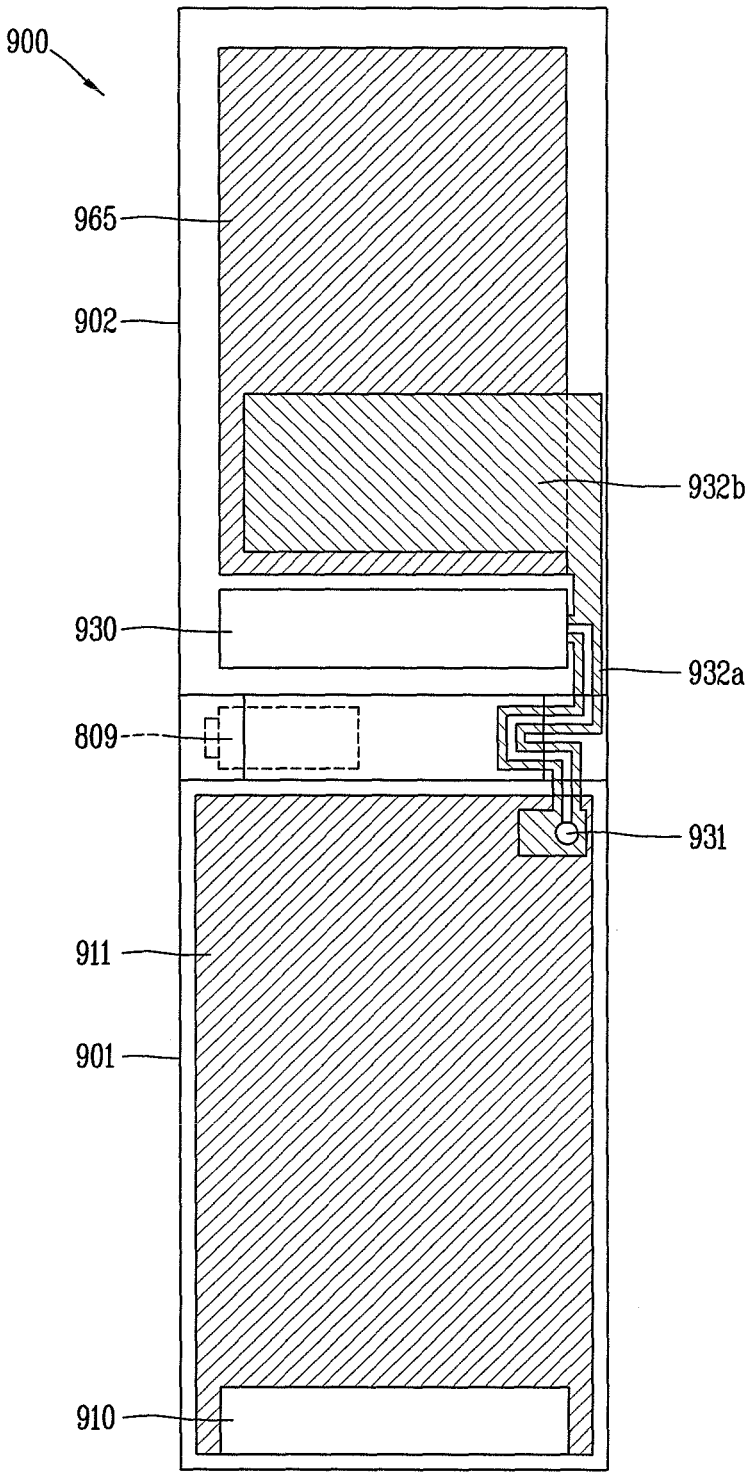

As illustrated in FIG. 19, a portable terminal 900 includes a first body 901, a second body 902, a first ground 911, a plug 931, a first antenna 910, a second antenna 930, and an LCD frame 965. Here, the second ground formed on the second body 902 is implemented not by directly contacting the LCD frame 965, but by increasing the area of an extension unit 932*b* of a flexible PCB 932*a* to a preset value. As a result, the extension unit 932*b* of the flexible PCB 932*a* is electrically isolated from the LCD frame 965. Through this configuration, it may be possible to implement the extension of the ground only by designing the flexible PCB 932*a* that can be easily fabricated.

Figure 20:
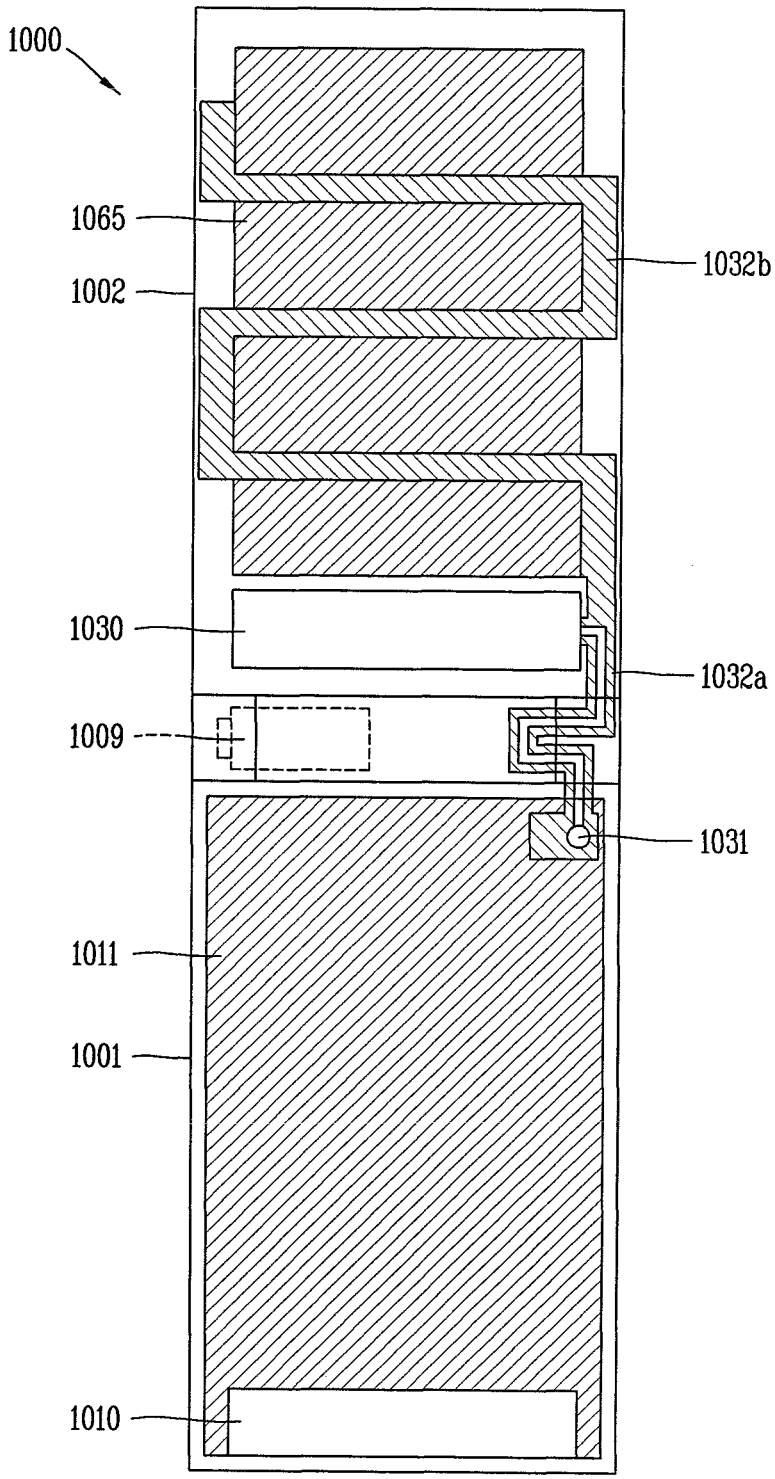

As illustrated in FIG. 20, a portable terminal 1000 includes a first body 1001, a second body 1002, a first ground 1011, a plug 1031, a first antenna 1010, a second antenna 1030, and an LCD frame 1065. The second ground formed on the second body 1002 is implemented not by directly contacting the LCD frame 1065, but by increasing the area of an extension unit 1032*b* of a flexible PCB 1032*a* to a preset value. However, a free pattern may be implemented for the extension unit 1032*b* of the flexible PCB 1032*a* in order to improve the performance.

Figure 21:
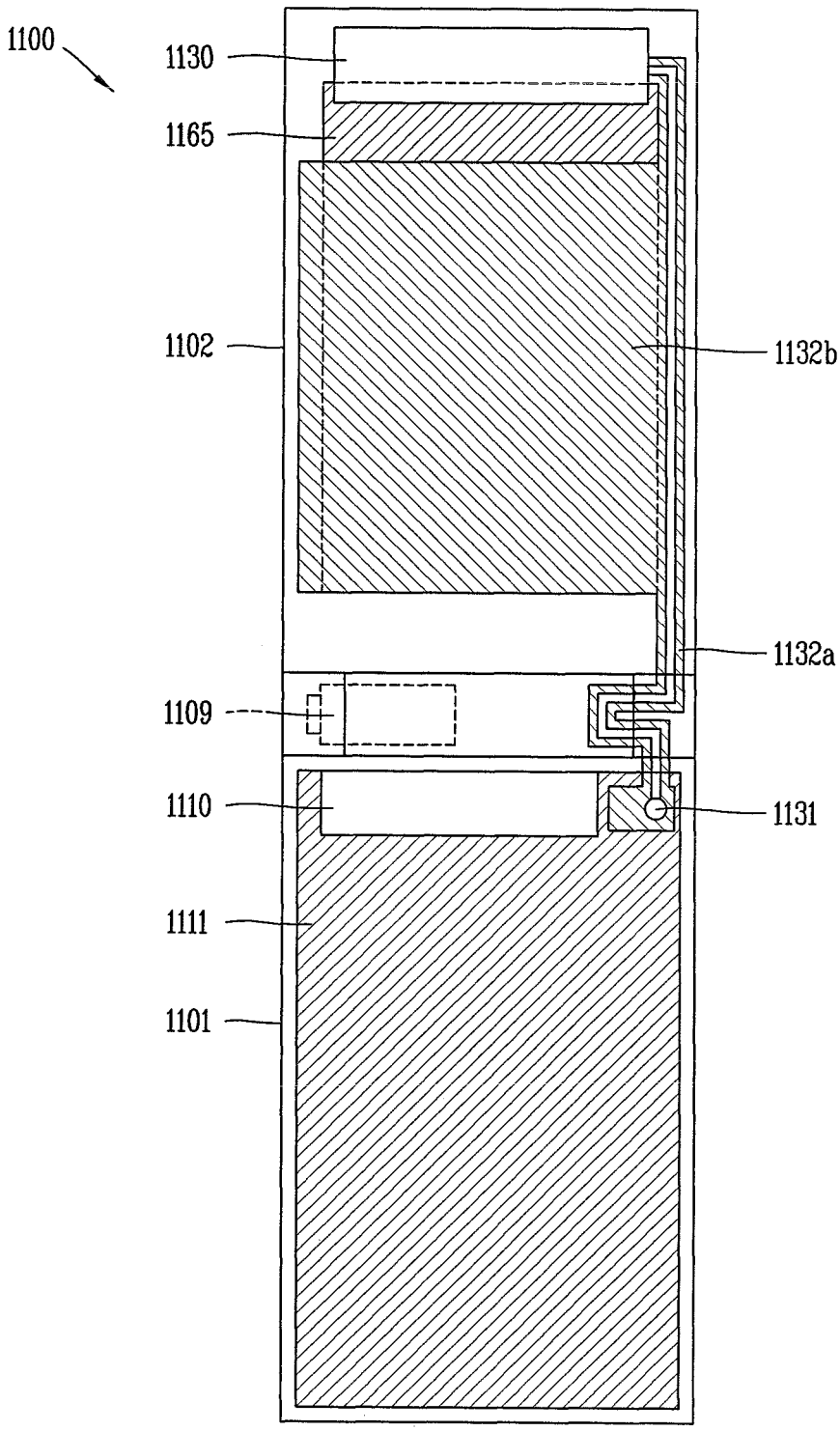

As illustrated in FIG. 21, a portable terminal 1100 includes a first body 1101, a second body 1102, a first ground 1111, a plug 1131, a first antenna 1110, a second antenna 1130, and an LCD frame 1165. In the configuration shown in FIG. 21, the first antenna 1110 is arranged at upper ends of the first body 1101 and the second antenna 1130 is arranged at a lower end of the second body 1102.

Figure 22:
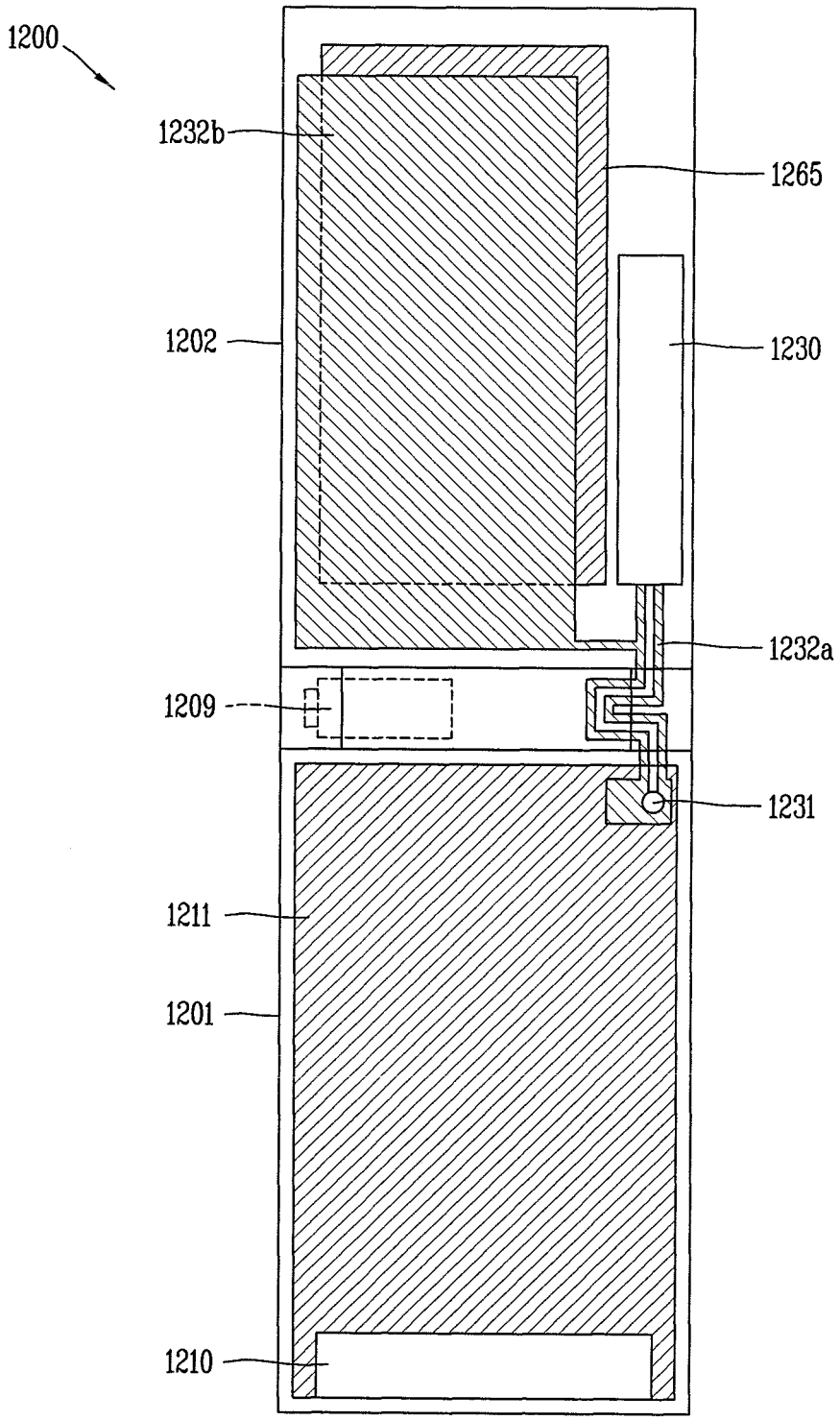

As illustrated in FIG. 22, a portable terminal 1200 includes a first body 1201, a second body 1202, a first ground 1211, a plug 1231, a first antenna 1210, a second antenna 1230, and an LCD frame 1265. In the configuration shown in FIG. 22, the second antenna 1230 is arranged at a lateral surface of the LCD frame 1265. In this case, the ground plane of the second antenna 1230 may be of small size and, therefore, it may be possible to increase the area by fabricating the extension unit 1232*b* of the flexible PCB 1232*a* with a multi-layer structure.

Figure 23:
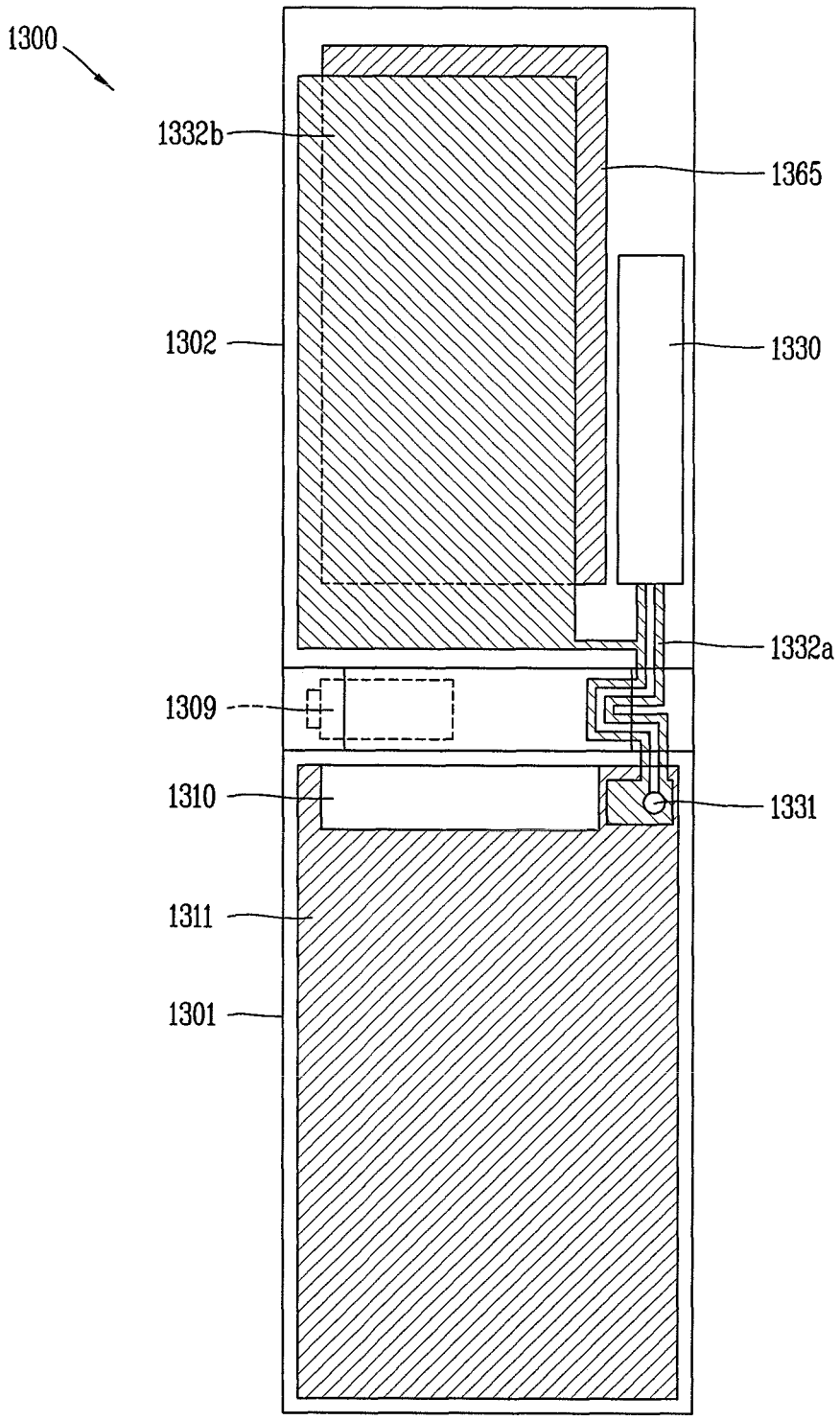

As illustrated in FIG. 23, a portable terminal 1300 includes a first body 1301, a second body 1302, a first ground 1311, a plug 1331, a first antenna 1310, a second antenna 1330, and an LCD frame 1365. In the configuration shown in FIG. 23, the second antenna 1330 is arranged at a lateral surface of the LCD frame 1365, and the first antenna 1310 is arranged at an upper end of the first body 1301.

A portable terminal and an antenna assembly of the portable terminal according to the present invention are not limited to the configurations discussed herein, but all or part of each embodiment in the present disclosure may be selectively combined with each other so as to implement various modifications of the embodiments.

As the exemplary embodiments may be implemented in several forms without departing from the characteristics thereof, it should also be understood that the embodiments described herein are not limited by any of the details of the foregoing description, unless otherwise specified, but rather should be construed broadly within its scope as defined in the appended claims. Therefore, various changes and modifications that fall within the scope of the claims, or equivalents of such scope, are intended to be embraced by the appended claims.

What is claimed is:

1. A portable terminal, comprising:

a terminal body;

a circuit board integrated with the terminal body, the circuit board having at least a front surface, a back surface, a first lateral surface, and a second lateral surface, wherein the first lateral surface and the second lateral surface are formed substantially vertically with respect to the front surface and the back surface;

a first antenna provided on the front or back surface of the circuit board proximate to an end portion of the terminal body, a first ground being formed on the front surface and used by the first antenna;

an antenna assembly integrated with the terminal body, the antenna assembly comprising at least one diversity antenna;

a second ground arranged on the first lateral surface of the circuit board such that a first portion of the second ground is in contact with the first lateral surface and a second portion of the second ground, which extends from the first portion of the second ground, is not in contact with the first lateral surface; and a third ground arranged on the second lateral surface of the circuit board such that a first portion of the third ground is in contact with the second lateral surface and a second portion of the third ground, which extends from the first portion of the third ground, is not in contact with the second lateral surface, the second portion of the second ground facing the second portion of the third ground, wherein the second ground and the third ground, which are independent from the first ground, are formed substantially vertically with respect to the first ground, wherein the at least one diversity antenna comprises:

a second antenna formed on the second ground; and a third antenna formed on the third ground.

2. The portable terminal of claim 1, wherein the second ground and the third ground are electrically isolated from the first ground.

3. The portable terminal of claim 1, wherein the at least one diversity antenna is fixed to an inner surface of the terminal body.

4. The portable terminal of claim 1, wherein the at least one diversity antenna is positioned to form an angle with respect to the first ground.

5. The portable terminal of claim 1, wherein the second antenna and the third antenna are not in direct contact with the first lateral surface and the second lateral surface.

6. The portable terminal of claim 1, wherein the second antenna is in contact with both the first portion and the second portion of the second ground and the third antenna is in contact with both the first portion and the second portion of the third ground.

7. The portable terminal of claim 1, wherein the first antenna is provided on the back surface of the circuit board.

8. The portable terminal of claim 1, further comprising a display mounted on the front surface of the circuit board.

9. The portable terminal of claim 1, wherein each of a height of the first lateral surface and a height of the second lateral surface corresponds to a thickness of the circuit board.

* * * * *